US009221276B2

(12) United States Patent
Takahashi et al.

(10) Patent No.: US 9,221,276 B2
(45) Date of Patent: Dec. 29, 2015

(54) SUBSTRATE MOUNTING STRUCTURE AND TAPE PRINTER

(71) Applicant: Brother Kogyo Kabushiki Kaisha, Nagoya-shi, Aichi-ken (JP)

(72) Inventors: Ryoya Takahashi, Gifu (JP); Takashi Goto, Nagoya (JP); Minoru Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/462,611

(22) Filed: Aug. 19, 2014

(65) Prior Publication Data

US 2015/0054904 A1 Feb. 26, 2015

(30) Foreign Application Priority Data

Aug. 20, 2013 (JP) ..... 2013-170735

(51) Int. Cl.
*B41J 2/32* (2006.01)
*B41J 3/407* (2006.01)

(52) U.S. Cl.
CPC ..... *B41J 3/4075* (2013.01)

(58) Field of Classification Search
None
See application file for complete search history.

(56) References Cited

U.S. PATENT DOCUMENTS

| | | | | |
|---|---|---|---|---|
| 6,305,784 | B1 * | 10/2001 | Hino | 347/49 |
| 6,693,868 | B2 | 2/2004 | Saito | |
| 2001/0021155 | A1 | 9/2001 | Saito | |

FOREIGN PATENT DOCUMENTS

| | | | |
|---|---|---|---|
| JP | H04-139796 | A | 5/1992 |
| JP | H08-88484 | A | 4/1996 |
| JP | H09-244655 | A | 9/1997 |
| JP | 2001-222877 | A | 8/2001 |
| JP | 2002-353662 | A | 12/2002 |
| JP | 2003-008244 | A | 1/2003 |

* cited by examiner

*Primary Examiner* — Stephen Meier
*Assistant Examiner* — Bradley Thies
(74) *Attorney, Agent, or Firm* — Banner & Witcoff, Ltd.

(57) ABSTRACT

A substrate mounting structure includes a substrate, a substrate support portion, a protruding portion, and a screw. The substrate has a first surface and a second surface that is a surface on an opposite side to the first surface. The substrate support portion includes a screw hole and is a section of an outer peripheral portion of the screw hole. The section comes into contact with the first surface of the substrate. The protruding portion is provided on at least a part of a section of the outer peripheral portion apart from the substrate support portion, and protrudes further in a direction from the first surface toward the second surface than the substrate support portion. The screw is screwed into the screw hole and clamps the substrate together with the substrate support portion.

7 Claims, 14 Drawing Sheets

SUBSTRATE MOUNTING STRUCTURE AND TAPE PRINTER

CROSS-REFERENCE TO RELATED APPLICATION

This application claims priority to Japanese Patent Application No. 2013-170735, filed on Aug. 20, 2013, the content of which is hereby incorporated by reference.

BACKGROUND

The present disclosure relates to a substrate mounting structure that mounts a substrate using screws, and to a tape printer that is provided with a function that performs printing on a tape, which is a print medium.

A substrate equipped with electronic components etc. is mounted on various types of devices using screws or a fixed leg portion. For example, in a known print substrate fixing method, two corners of a side of a print substrate are inserted into a guide groove of a print substrate fixing guide, and the print substrate is caused to slide. After that, the print substrate is mounted on a mounting strip or a spacer via mounting holes that are provided in two corners of the opposite side of the print substrate.

SUMMARY

In the known print substrate fixing method, it is necessary to secure a space to provide the mounting holes in the print substrate.

It is an object of the present disclosure to provide a substrate mounting structure and a tape printer that are capable of achieving space saving and size reduction of a substrate and capable of stably mounting the substrate.

Embodiments provide a substrate mounting structure that includes a substrate, a substrate support portion, a protruding portion, and a screw. The substrate has a first surface and a second surface that is a surface on an opposite side to the first surface. The substrate support portion includes a screw hole and is a section of an outer peripheral portion of the screw hole. The section comes into contact with the first surface of the substrate. The protruding portion is provided on at least a part of a section of the outer peripheral portion apart from the substrate support portion, and protrudes further in a direction from the first surface toward the second surface than the substrate support portion. The screw is screwed into the screw hole and clamps the substrate together with the substrate support portion.

Embodiments also provide a tape printer that includes a substrate mounting structure. The substrate mounting structure includes a substrate, a substrate support portion, a protruding portion, and a screw. The substrate has a first surface and a second surface that is a surface on an opposite side to the first surface. The substrate support portion includes a screw hole and is a section of an outer peripheral portion of the screw hole. The section comes into contact with the first surface of the substrate. The protruding portion is provided on at least a part of a section of the outer peripheral portion apart from the substrate support portion, and protrudes further in a direction from the first surface toward the second surface than the substrate support portion. The screw is screwed into the screw hole and clamps the substrate together with the substrate support portion.

BRIEF DESCRIPTION OF THE DRAWINGS

Embodiments will be described below in detail with reference to the accompanying drawings in which.

DETAILED DESCRIPTION

An embodiment that embodies the present disclosure will be explained with reference to the drawings. Note that the drawings are used to explain technological features that can be adopted by the present disclosure, and are not intended to limit the content. In the explanation of the present embodiment, the upper side, the lower side, the left side, the right side, the front side and the back side of FIG. 1 respectively correspond to the upper side, the lower side, the rear side, the front side, the left side and the right side of a tape printer 1. A tape cassette 30 side of a feed path and a discharge path that are supplied from the tape cassette 30 is referred to as an upstream side, and a discharge port 25 side is referred to as a downstream side.

The tape printer 1 will be explained with reference to FIG. 1. The tape printer 1 is a general-purpose tape printer that can be electrically connected to a computer device (a personal computer, for example). The tape printer 1 performs printing of characters on a tape based on data of the characters (letters, numbers, graphics and the like) transmitted from the computer device. The tape is a print medium that is supplied from a tape cassette. The single tape printer 1 can use various types of the tape cassette 30, such as a thermal type, a receptor type, a laminate type and a tube type. In accordance with the type of the tape cassette 30, the tape cassette 30 houses therein a different type of tape. A heat-sensitive paper tape, a print tape, a double-sided adhesive tape, a tube tape and a film tape are examples of the types of tape. The thermal type tape cassette is provided with a heat-sensitive paper tape. The receptor type tape cassette is provided with a print tape and an ink ribbon. The laminate type tape cassette is provided with a double-sided adhesive tape, a film tape and an ink ribbon. The tube type tape cassette is provided with a heat shrinkable tube tape and an ink ribbon. In the explanation below, when the types of tape housed in the tape cassette 30 are collectively referred to or when they are not particularly distinguished, they are simply referred to as a tape. Attributes (for example, a tape width, a print format, a tape color, a print color and the like) of the tape that is housed in the tape cassette 30 are collectively referred to as tape attributes.

Figure 1:
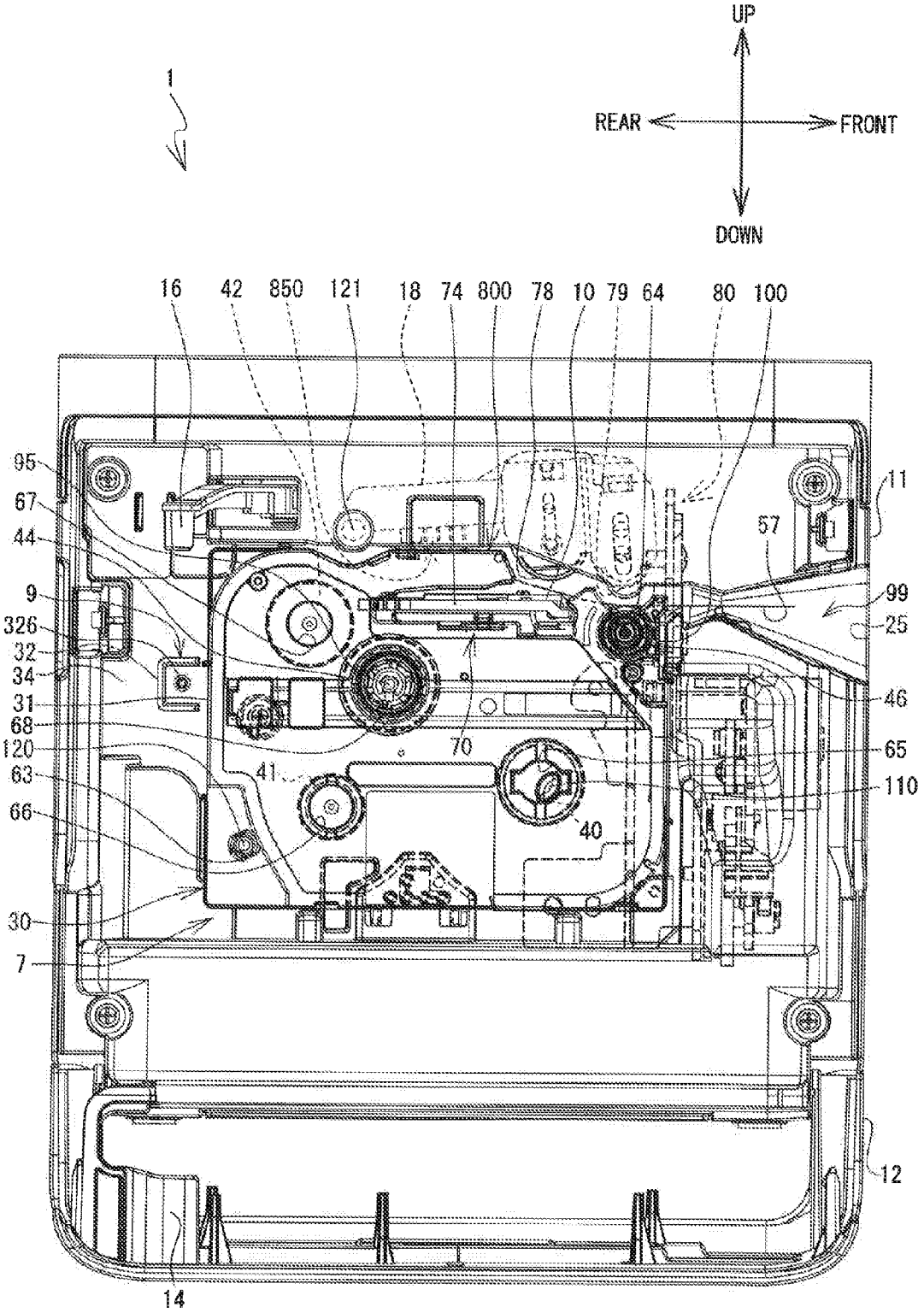
FIG. 1 is a left side view of a tape printer 1 when a left cover 12 is in an open state and a tape cassette 30 mounted in a cassette mounting portion 7.

As shown in FIG. 1, the tape printer 1 includes a main body portion 11 and a left cover 12. FIG. 1 shows a state in which the left cover 12 is opened with respect to the main body portion 11. The main body portion 11 is provided with a cassette mounting portion 7, a sensor arrangement portion 9, a printing mechanism 70, a cutting mechanism 80, a discharge portion 99 and a battery housing portion (not shown in the drawings). The cassette mounting portion 7 is a portion into and from which the tape cassette 30 can be mounted and removed. The sensor arrangement portion 9 is a portion in which a mechanical sensor 33 that detects a closed state of the left cover 12 is arranged. The printing mechanism 70 is a mechanism configured to perform printing on a tape 57 that is supplied from the tape cassette 30. The cutting mechanism 80 is provided on a downstream side of the printing mechanism 70, and is a hinge type mechanism configured to cut the printed tape 57 at a predetermined length. The discharge portion 99 has the discharge port 25, and is a portion configured to discharge a label, which is a tape cut by the cutting mechanism 80, to the outside of the tape printer 1. The cassette mounting portion 7, the printing mechanism 70, the cutting mechanism 80 and the discharge portion 99 are each provided on the side of the left side surface of the main body portion 11. The battery housing portion is a portion that can house a battery that supplies electric power to the tape printer 1, and is provided on the side of the right side surface of the main body portion 11.

The left cover 12 is a rectangular cover in a left side view. The left cover 12 can rotate between a closed position and an open position. The closed position is a position where the left cover 12 is axially supported in the front-rear direction in a lower left portion of the main body portion 11 and covers the left side of the main body portion 11. The open position is a position where the left side of the main body portion 11 shown in FIG. 1 is exposed to the outside. For example, the left cover 12 is moved to the open position when the tape cassette 30 is mounted or removed. A lever pressing portion 14 and a sensor pressing portion (not shown in the drawings) are provided on the right surface of the left cover 12 in a state in which the left cover 12 is closed. When the left cover 12 is in the closed position, the lever pressing portion 14 presses a lever 16 (which will be described later) to the right. When the left cover 12 is in the closed position, the sensor pressing portion presses a switch 326 of a sensor 33 shown in FIG. 11 to the right.

As shown in FIG. 1, the tape cassette 30 is provided with a cassette case 31 that has rounded corners and that is substantially rectangular (box-shaped) as a whole. The cassette case 31 is provided with three support holes 64, 65 and 68 that penetrate in the left-right direction. The support hole 64 rotatably supports a roller 46. In cooperation with a movable feed roller 79 that will be described later, the roller 46 feeds the tape supplied from the cassette case 31 along a predetermined feed path. Each of the support holes 65 and 68 rotatably supports a spool or the like that is mounted inside the cassette case 31. The support hole 65 rotatably supports a spool 40 around which a tape is wound. The support hole 68 rotatably supports a spool 44 that is used to take up a tape supplied from a spool 42. The cassette case 31 is further provided with support holes 66 and 67 that extend in the left-right direction. The support hole 66 rotatably supports a spool 41 around which a tape is wound. The support hole 67 rotatably supports the spool 42 around which the tape is wound. The cassette case 31 is further provided with a hole 63 that penetrates in the left-right direction in a lower rear portion of the cassette case 31. The tape that is wound around each of the spools 40 to 42 is set according to the type of the tape cassette 30.

The top surface of the cassette case 31 is provided with an indicator portion 800 that indicates some of the tape attributes of the tape cassette 30. The indicator portion 800 includes at least one hole portion (not shown in the drawings) that is provided in a prescribed pattern corresponding to some of the tape attributes of the tape cassette 30. Each of the hole portions is provided in a position that corresponds to one of five detection switches 851 to 855. The five detection switches 851 to 855 are provided on a detection portion 850 which is provided on the tape printer 1 and which will be described later with reference to FIG. 5. Therefore, when the tape cassette 30 is mounted in the tape printer 1, the detection switches 851 to 855 are selectively pressed by the indicator portion 800. In the tape printer 1, some of the tape attributes of the tape cassette 30 are detected based on combinations of pressing (ON) and non-pressing (OFF) of the detection switches 851 to 855 of the detection portion 850.

The cassette mounting portion 7 is an area where the tape cassette 30 is insertable and removable in the left-right direction. The cassette mounting portion 7 is recessed so as to substantially correspond to the shape of the right side surface of the cassette case 31. The cassette mounting portion 7 is provided with shafts 95, 100, 110 and 120 that extend from the right to the left. The shaft 95 is arranged in a standing condition in a central portion in the front-rear direction on the upper side of the cassette mounting portion 7. The shaft 95 is a shaft-shaped member that can be inserted into the spool 44 of the tape cassette 30. The shaft 100 is arranged in a standing condition in front of the shaft 95. The shaft 100 is a shaft-shaped member that can be inserted into the roller 46 of the tape cassette 30. The shaft 110 is arranged in a standing condition below and to the rear of the shaft 100. The shaft 110 is a shaft-shaped member that can be inserted into the support hole 65 of the tape cassette 30. The shaft 120 is arranged in a standing condition in a lower rear portion of the cassette mounting portion 7. The shaft 120 is a shaft-shaped member that can be inserted into the hole 63 of the tape cassette 30.

The sensor arrangement portion 9 is a recessed portion that is provided to the rear of the cassette mounting portion 7. The sensor arrangement portion 9 has a cover 32 and the mechanical switch 326 of the sensor 33 (refer to FIG. 11) that will be described later. The cover 32 surrounds the upper side, the rear side and the lower side of the switch 326. The sensor 33 is fixed on the right surface side of a wall 34. The switch 326 protrudes to the left from the wall 34.

The printing mechanism 70 is configured to perform printing on the tape supplied from the cassette mounting portion 7 based on the data transmitted from the computer device (not shown in the drawings). The printing mechanism 70 is provided with a head holder 74. The head holder 74 is provided above the cassette mounting portion 7. The head holder 74 is formed of a single sheet of a plate-shaped member that extends in the front-rear direction. The top surface of the head holder 74 is provided with a thermal head 10 that includes a heating element (not shown in the drawings).

The printing mechanism 70 is provided with an arm-shaped roller holder 18 that extends in the front-rear direction above the head holder 74. The roller holder 18 is pivotally supported by the main body portion 11 such that the roller holder 18 can pivot around a holder shaft 121. A platen roller 78 and a movable feed roller 79 are rotatably and pivotally supported by a front portion of the roller holder 18. The platen roller 78 can come into contact with and separate from the thermal head 10. The movable roller 79 can come into contact with and separate from the roller 46 of the tape cassette 30. A tape drive motor (not shown in the drawings), which is a stepping motor, is disposed on the back side (the right side) of the cassette mounting portion 7. The shaft 95 and the roller 46 are connected to the tape drive motor via a plurality of gears (not shown in the drawings), respectively, and are configured to rotate in accordance with the drive of the tape drive motor.

A schematic configuration of a movable mechanism 200 will be explained with reference to FIG. 2 to FIG. 8. The movable mechanism 200 of the present embodiment includes the lever 16, a release rod 17, the roller holder 18, a wall portion 20 and a substrate mounting structure 19. The upper left side, the lower right side, the left side, the right side, the lower left side and the upper right side of FIG. 2 respectively correspond to the left side, the right side, the lower side, the upper side, the front side and the rear side of the movable mechanism 200. The upper left side, the lower right side, the upper right side, the lower left side, the upper side and the lower side of FIG. 3 respectively correspond to the upper side, the lower side, the front side, the rear side, the left side and the right side of the movable mechanism 200.

Figure 2:
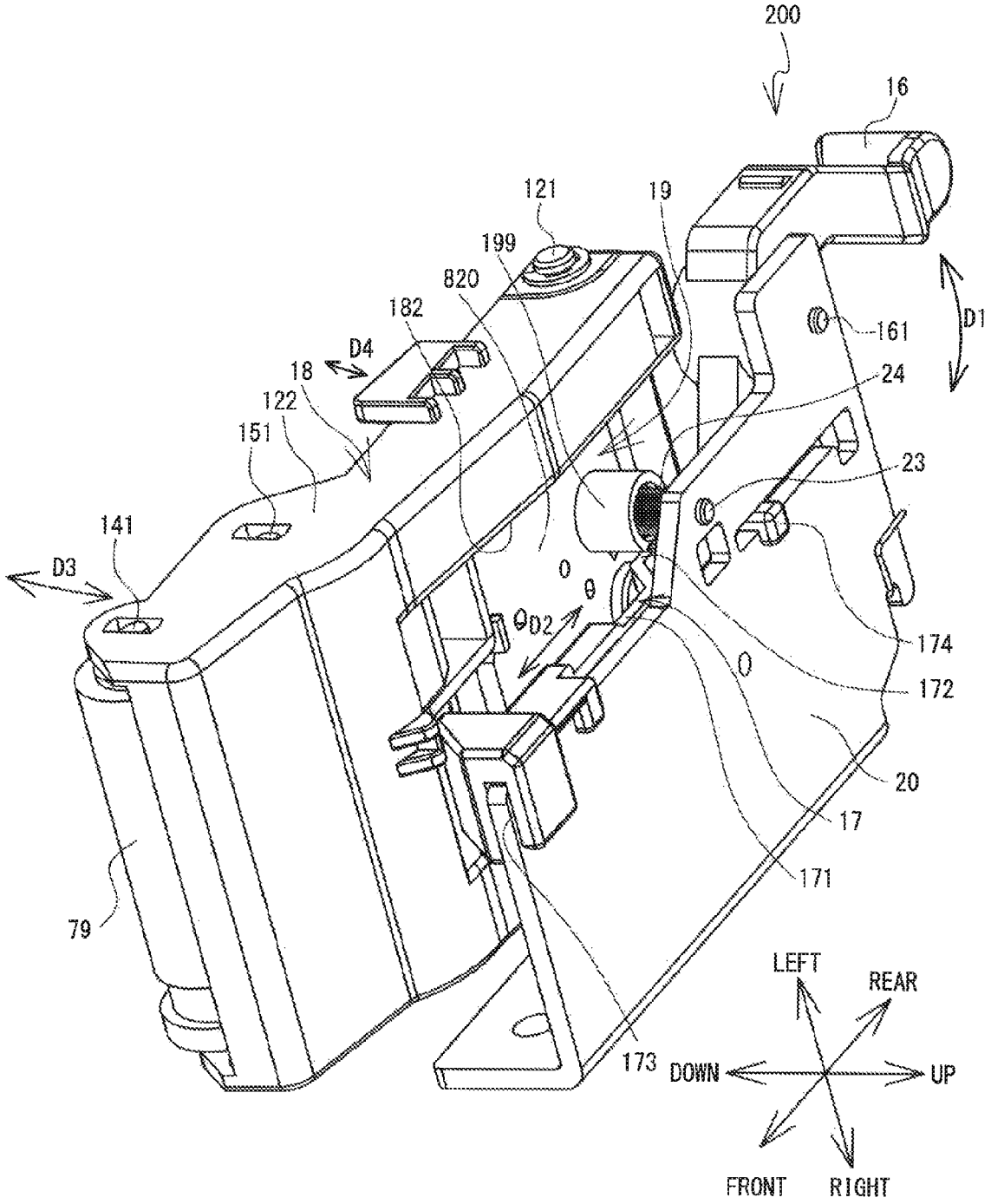
FIG. 2 is a perspective view of a movable mechanism 200.
Figure 3:
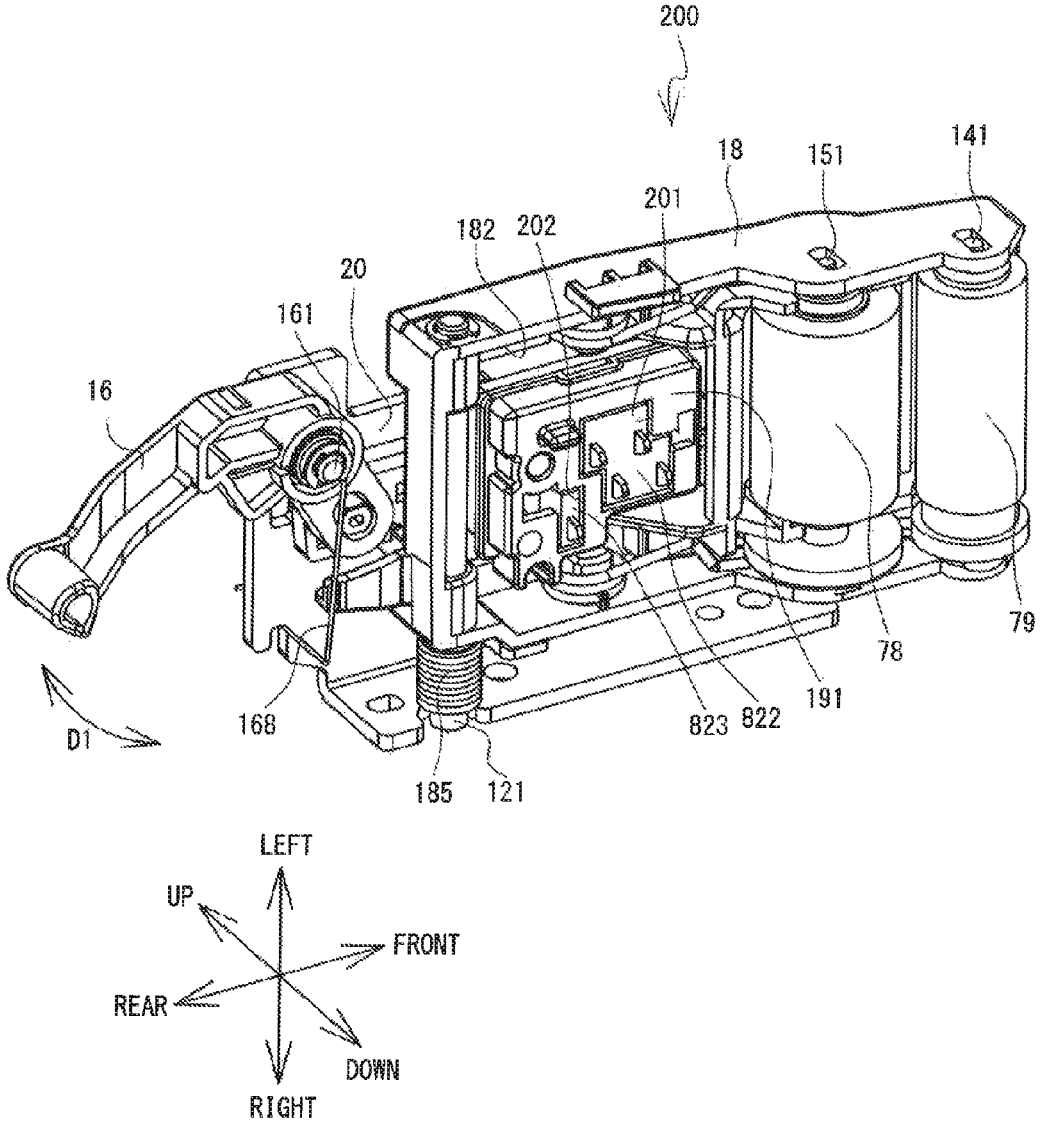
FIG. 3 is a perspective view of the movable mechanism 200.

As shown in FIG. 2 and FIG. 3, the lever 16 has a predetermined thickness and a predetermined width, and is curved in a substantially arc shape that extends to the left and to the rear in a plan view. The lower end of the lever 16 is provided with a lever shaft portion 161 that rotatably supports the lever 16. A coil portion of a coil spring 168 (refer to FIG. 3) is mounted on the lever shaft portion 161. The coil spring 168 is provided with two arm portions that extend from the coil portion to the outer diameter side. One of the arm portions is fixed to the lever 16, and the other arm portion is fixed to the wall portion 20. The coil spring 168 urges the lever 16 such that the lever 16 is rotated to the left (the counter-clockwise direction in FIG. 2) by an elastic force. In accordance with opening and closing operations of the left cover 12, the lever 16 rotates around the lever shaft portion 161 in the left-right direction (a rotation direction D1 shown in FIG. 3). The lever 16 rotates to the left when the left cover 12 is opened to the left. The lever 16 rotates to the right when the left cover 12 is closed to the right.

As shown in FIG. 2, the release rod 17 is a plate-shaped member that is long in the front-rear direction in a plan view. The release rod 17 engages with the front end of the lever 16. The release rod 17 is provided with a first engagement portion 171 and a second engagement portion 172 that are plate shaped and long in the front-rear direction. The first engagement portion 171 extends above and in front of the second engagement portion 172. The release rod 17 is further provided with a first guide portion 173 and a second guide portion 174. The first guide portion 173 and the second guide portion 174 are claw portions which protrude upward and whose leading ends are bent to the right. The first guide portion 173 and the second guide portion 174 guide the movement of the release rod 17 in the front-rear direction. The release rod 17 moves in the front-rear direction (a movement direction D2 shown in FIG. 2) in accordance with the rotation of the lever 16. Although details will be described later, when the lever 16 is in a leftmost position, the release rod 17 is at the rear end of its movable range. When the lever 16 rotates to the right (the downward direction in FIG. 2), the release rod 17 moves in the forward direction (the lower left direction in FIG. 2). When the lever 16 rotates to the left (the upward direction in FIG. 2), the release rod 17 moves in the rearward direction (the upper right direction in FIG. 2).

As shown in FIG. 2 and FIG. 3, the roller holder 18 is a box-shaped body which is provided below the release rod 17 (refer to FIG. 2) and which opens downward. The roller holder 18 is pivotally supported such that it can rotate around the holder shaft 121 that extends in the left-right direction. A coil spring 185 (refer to FIG. 3) is mounted on the holder shaft 121. The platen roller 78 (refer to FIG. 1 and FIG. 3) and the movable feed roller 79 are rotatably supported inside the roller holder 18. Roller surfaces of the platen roller 78 and the movable feed roller 79 are exposed downward from the roller holder 18. The movable feed roller 79 is disposed on the front end edge of the roller holder 18. The platen roller 78 is disposed to the rear of the movable roller 79. The movable feed roller 79 and the platen roller 78 are respectively disposed in positions facing the roller 46 and the thermal head 10 (refer to FIG. 1). An opening portion 182 is provided in the roller holder 18 (refer to FIG. 3). The opening portion 182 is provided between the holder shaft 121 and the platen roller 78.

The roller holder 18 is urged upward by the coil spring 185 (refer to FIG. 3). Along with the movement of the release rod 17 in the front-rear direction (the movement direction D2), the roller holder 18 rotates around the holder shaft 121 in the up-down direction (a rotation direction D3 shown in FIG. 2). When the release rod 17 moves in the forward direction, the roller holder 18 rotates downward against an urging force of the coil spring 185. When the release rod 17 moves in the rearward direction, the roller holder 18 rotates upward due to the urging force of the coil spring 185. The wall portion 20 is a plate-shaped member that extends in the front-rear direction above the roller holder 18, and has a shape in which the right end is folded downward.

Figure 4:
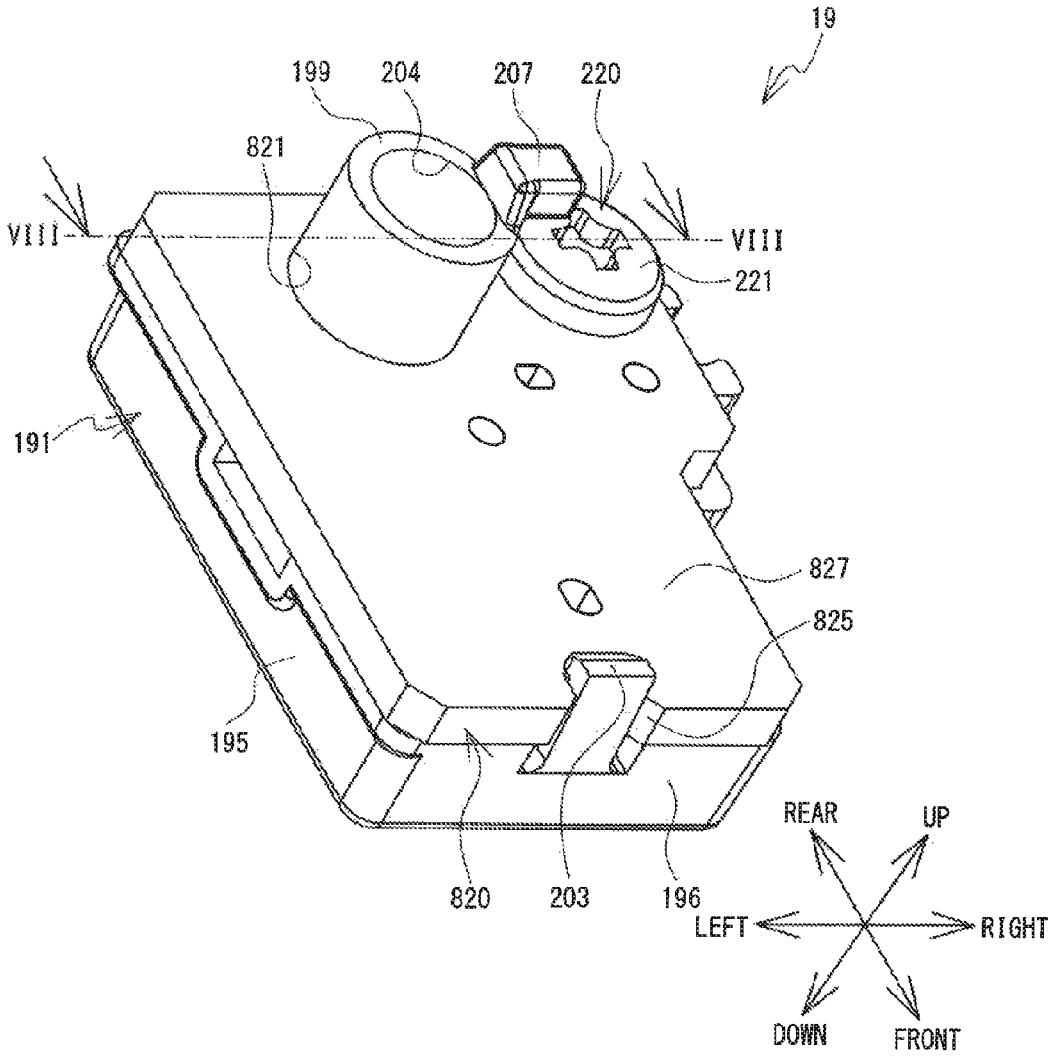
FIG. 4 is a perspective view of a substrate mounting structure 19.

The substrate mounting structure 19 is provided inside the opening portion 182, below (on the upper left side in FIG. 2) the release rod 17. As shown in FIG. 4, the substrate mounting structure 19 mainly includes a sensor substrate 820 and a box-shaped unit main body 191.

Figure 5:
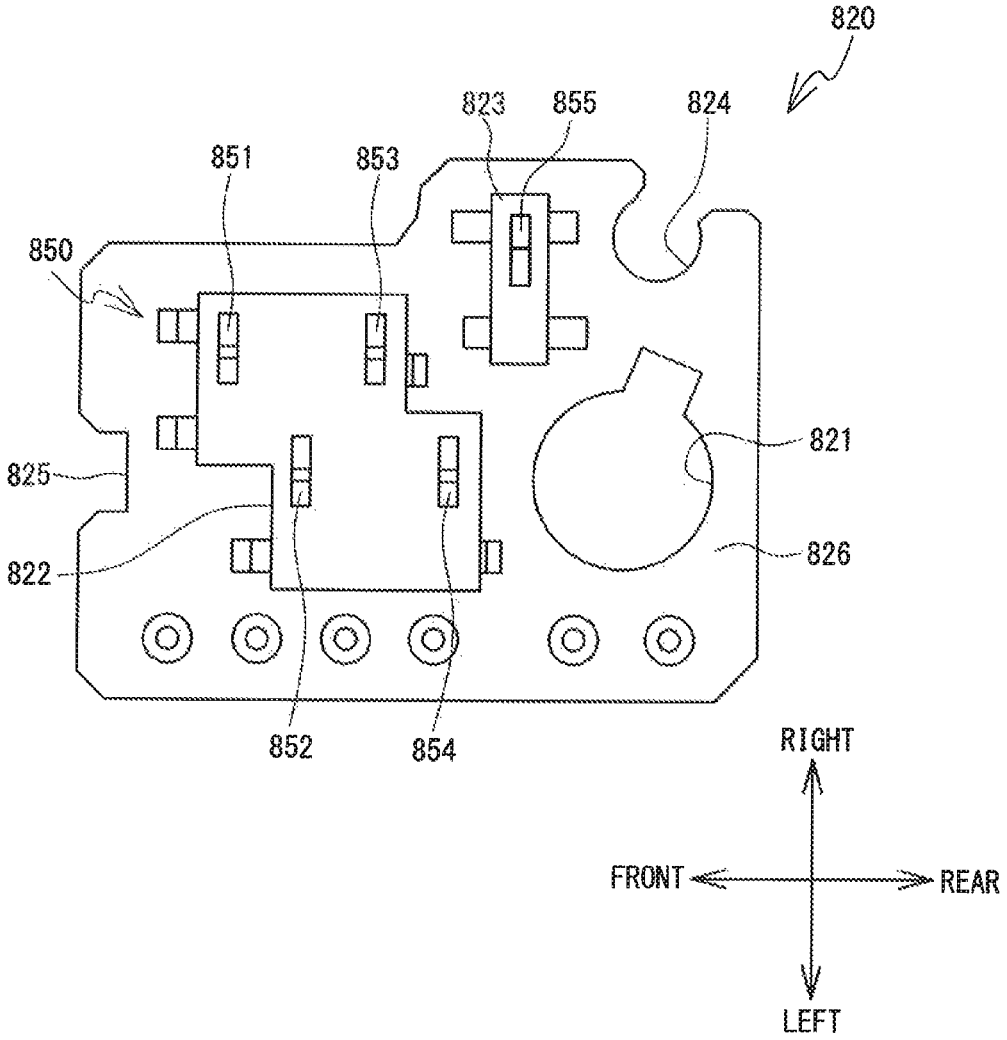
FIG. 5 is a bottom view of a sensor substrate 820.

As shown in FIG. 5, the sensor substrate 820 is a plate-shaped member having a substantially rectangular shape in a bottom view. The detection portion 850 is mounted on a first surface 826 that is the bottom surface of the sensor substrate 820. Although not shown in the drawings, electrical wiring is connected to a second surface 827 (refer to FIG. 4) that is the top surface of the sensor substrate 820. The sensor substrate 820 is electrically connected to a control portion that is provided inside the tape printer 1, via the electrical wiring. Specifically, the bottom surface of the sensor substrate 820 is provided with sensors 822 and 823 that serve as the detection portion 850. The sensor 822 integrally holds the four detection switches 851 to 854. The sensor 823 holds the detection switch 855. The detection switches 851 to 855 each protrude downward. In other words, the detection switches 851 to 855 each protrude such that they face the indicator portion 800 of the tape cassette 30 that is mounted in the cassette mounting portion 7. The detection switches 851 to 855 are respectively provided in positions corresponding to the indicator portion 800.

The sensor substrate 820 is provided with a hole portion 821 and cutout portions 824 and 825. The hole portion 821 is a substantially circular hole in a bottom view that is provided in a rear portion of the sensor substrate 820. The cutout portion 824 is a portion obtained by cutting out the vicinity of the rear right corner of the sensor substrate 820, to the front left side. The cutout portion 824 is provided in order to insert a screw 220 through a section that corresponds to a screw hole 208, which will be described later. The cutout portion 825 is a portion obtained by cutting out a central portion, in the left-right direction, of the front side of the sensor substrate 820, to the rear side.

Figure 6:
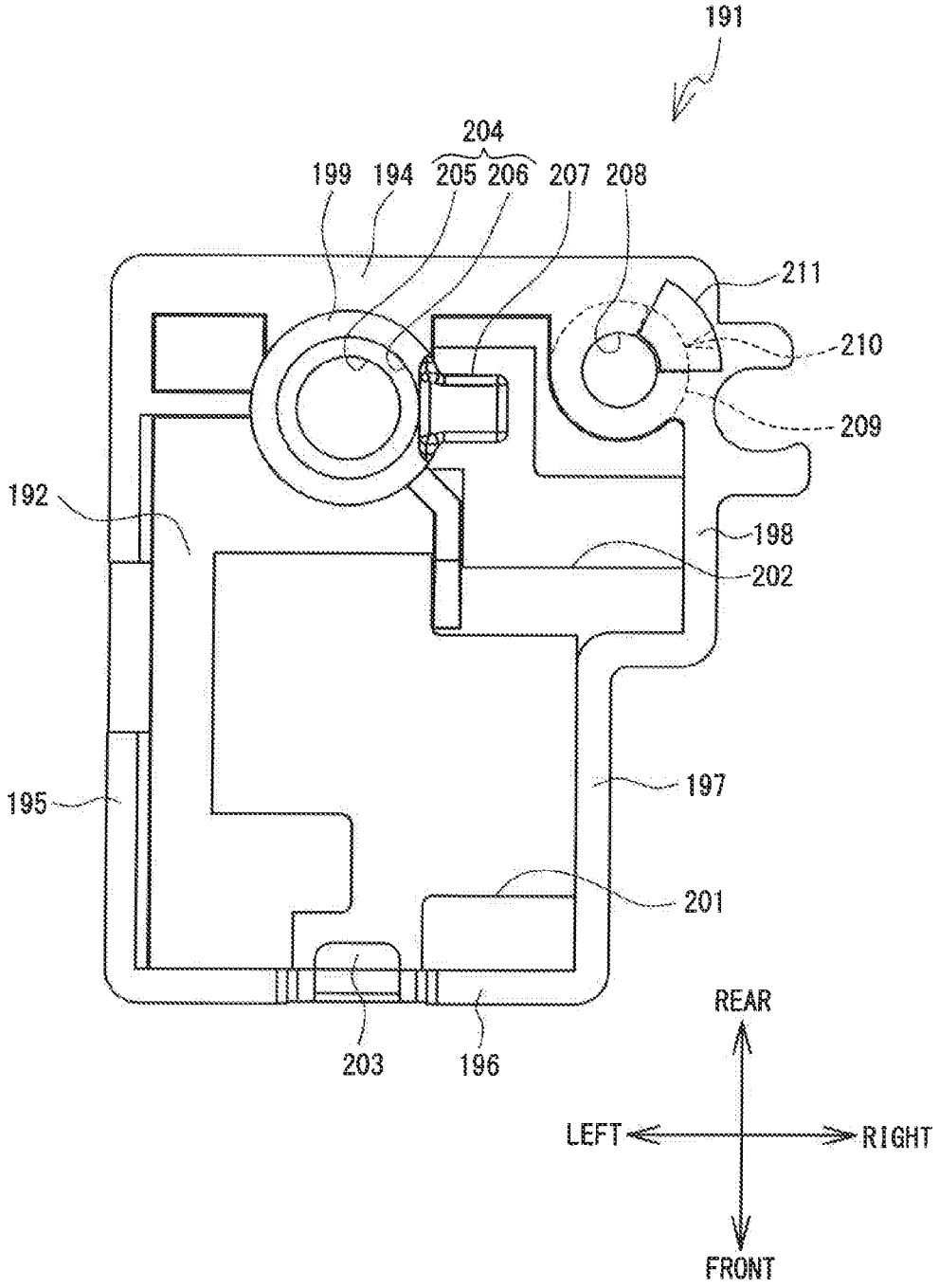
FIG. 6 is a plan view of a unit main body 191.
Figure 7:
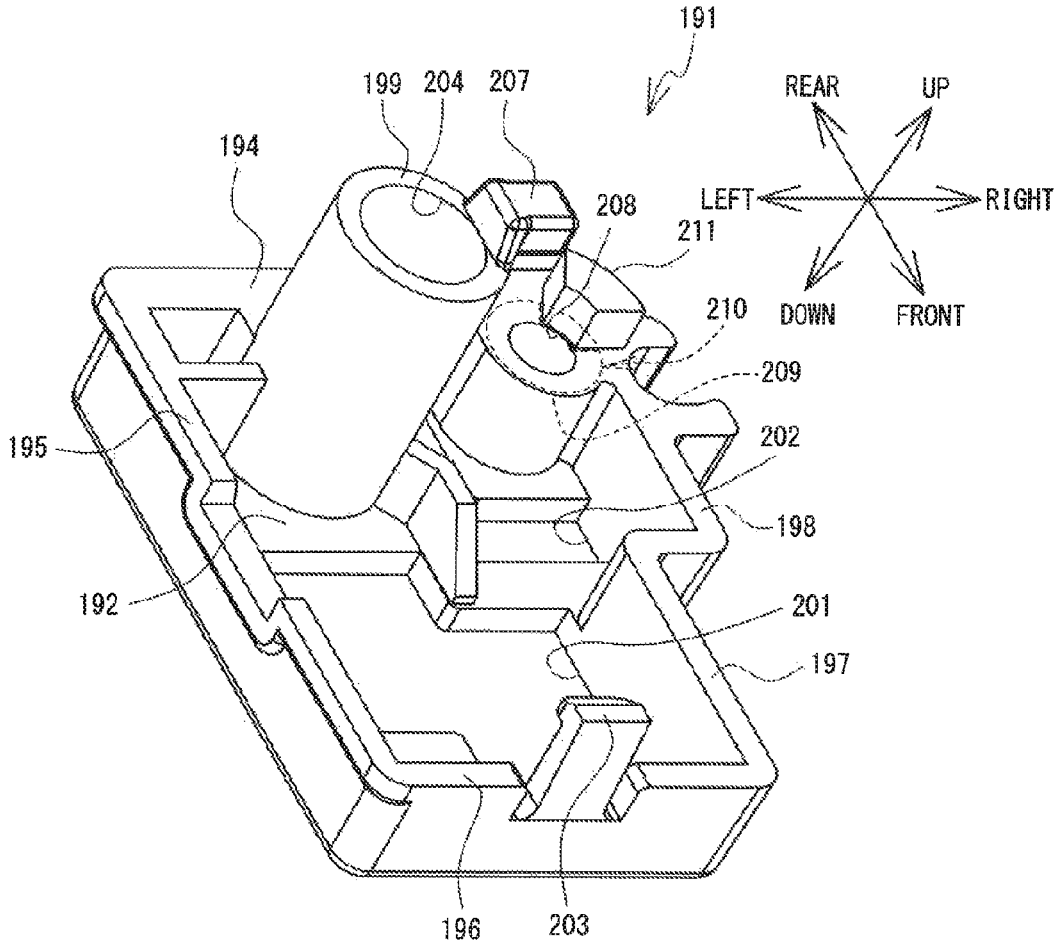
FIG. 7 is a perspective view of the unit main body 191.

As shown in FIG. 6 and FIG. 7, the unit main body 191 is a box-shaped body that opens upward. The sensor substrate 820 is held on the upper side of the unit main body 191. The unit main body 191 is provided with a lower wall 192, a rear wall 194, a left wall 195, a front wall 196, and right walls 197 and 198. The lower wall 192 is provided with openings 201 and 202 that are openings formed in two positions. The opening 202 is formed in a substantially rectangular shape that is long in the left-right direction. The opening 201 is located to the front left (the lower left in FIG. 3) of the opening 202, and is formed in a rectangular shape having an opening area that is larger than that of the opening 202. The unit main body 191 has a cylindrical portion 199 that has a cylindrical shape and extends upward from the lower wall 192. The cylindrical portion 199 has a shaft hole 204 that extends in the up-down direction. A columnar member 23 having a smaller diameter than the shaft hole 204 is inserted into the shaft hole 204 (refer to FIG. 2). The shaft hole 204 of the cylindrical portion 199 includes a first shaft hole 205 and a second shaft hold 206 that are coaxially communicated with each other. The first shaft hole 205 extends upward from the lower wall 192 to the vicinity of the center of the cylindrical portion 199. The second shaft hole 206 extends from the first shaft hole 205 to the upper end of the cylindrical portion 199, and has an opening diameter that is larger than that of the first shaft hole 205. The columnar member 23 that is inserted into the shaft hole 204 of the cylindrical portion 199 can slide in the up-down direction along the first shaft hole 205 that has substantially the same diameter as the columnar member 23. The upper leading end of the columnar member 23 is fixed to the wall portion 20.

The opening diameter of the second shaft hole 206 is larger than the diameter of the columnar member 23. A spring member 24 (refer to FIG. 2) is housed between the columnar member 23 and the cylindrical portion 199 such that the columnar member 23 is inserted into the winding center of the spring member 24. The total length of the spring member 24 is larger than the shaft length of the second shaft hole 206. The lower end of the spring member 24 is in contact with a step section that is formed by the difference in diameter between the first shaft hole 205 and the second shaft hole 206. The upper end of the spring member 24 is in contact with the wall portion 20. The spring member 24 urges the substrate mounting structure 19 downward (to the left in FIG. 2).

A guide portion 207 that extends to the right is provided on an opening edge portion of an upper portion of the cylindrical portion 199. The leading end of the guide portion 207 that is curved to the right is engaged with the first engagement portion 171 or the second engagement portion 172 of the release rod 17. The engagement between the guide portion 207 and the release rod 17 restricts the downward movement of the substrate mounting structure 19 that is urged downward by the spring member 24. The position of the substrate mounting structure 19 in the up-down direction with respect to the wall portion 20 is determined corresponding to a target with which the guide portion 207 is engaged. Along with the movement of the release rod 17 in the front-rear direction, the substrate mounting structure 19 moves in the up-down direction while being guided by the first engagement portion 171 and the second engagement portion 172 of the release rod 17.

A hook 203 is provided at a central portion of the front wall 196 of the unit main body 191. The hook 203 protrudes upward and its leading end is curved to the rear. The screw hole 208 to mount the sensor substrate 820 is provided in a rear right portion of the unit main body 191 in a plan view. Of a ring-shaped outer peripheral portion 210 of the screw hole 208, a section that comes into contact with the first surface 826 (refer to FIG. 5) of the sensor substrate 820 is referred to as a substrate support portion 209. The unit main body 191 is provided with a protruding portion 211 that protrudes further in a first protruding direction than the substrate support portion 209. The protruding portion 211 is provided on at least a part of a section of the outer peripheral portion 210 excepting the substrate support portion 209. The first protruding direction is a direction (a direction D6 in FIG. 8) from the first surface 826 of the sensor substrate 820 toward the second surface 827 (refer to FIG. 4), and in the present embodiment, the first protruding direction is the upward direction. In the present embodiment, the top surface of the protruding portion 211 is a flat surface, and the height of the protruding portion 211 in the first protruding direction from the substrate support portion 209 is substantially the same as the thickness of the sensor substrate 820.

Figure 8:
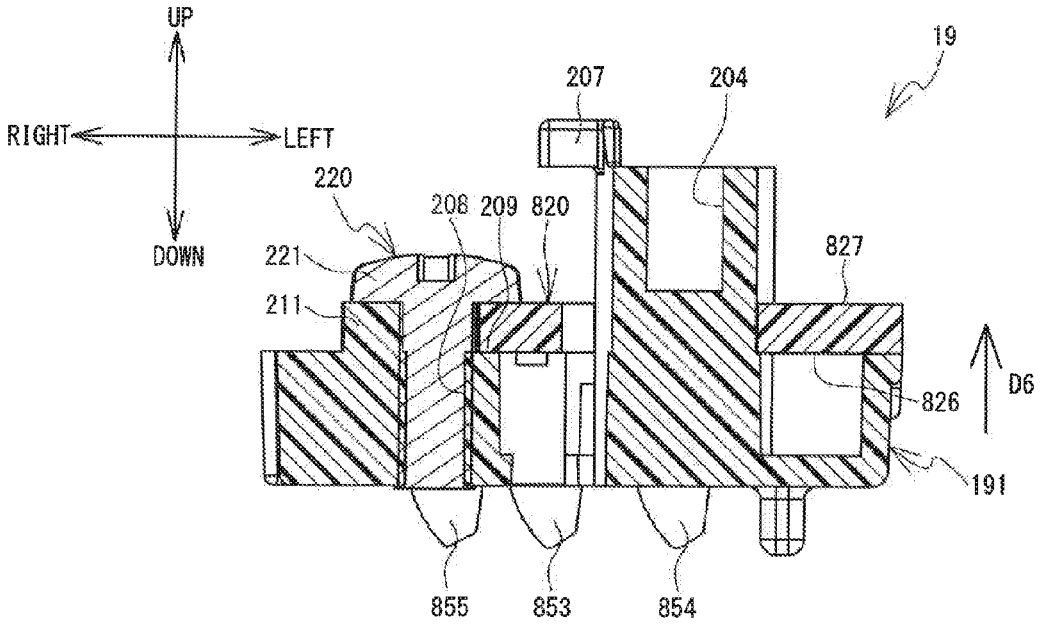
FIG. 8 is a cross-sectional view taken in the direction of arrows on a line VIII-VIII of the substrate mounting structure 19 shown in FIG. 4.

The sensor substrate 820 is mounted on the unit main body 191 in the following manner. In a state in which the first surface 826 of the sensor substrate 820 is directed downward, the hole portion 821 is passed through the cylindrical portion 199 and the sensor substrate 820 is placed on the top surface of the unit main body 191. The cutout portion 825 on the front side of the sensor substrate 820 is fixed by the hook 203. The screw 220 is tightened into the screw hole 208. A rear right portion of the sensor substrate 820 is clamped between a head portion 221 of the screw 220 and the substrate support portion 209. The sensor 822 is fitted into the opening 201. The sensor 823 is fitted into the opening 202. In the present embodiment, as shown in FIG. 8, the head portion 221 of the screw 220 comes into contact with both the second surface 827 of the sensor substrate 820 and the protruding portion 211. The first surface 826 of the sensor substrate 820 comes into contact with the substrate support portion 209 and the top surfaces of the rear wall 194, the left wall 195, the front wall 196 and the right walls 197 and 198.

An operation mode of the movable mechanism 200 when the left cover 12 is closed will be explained. The lever 16 is urged leftward (upward and slightly to the left in FIG. 2) by the coil spring 168 (refer to FIG. 3). When the left cover 12 is in an open position due to the urging force of the lever 16, the leading end of the lever 16 is in the leftmost position. At this time, the release rod 17 that is connected to the front end of the lever 16 is at the rear end position of the movable range of the release rod 17. The guide portion 207 (refer to FIG. 4) is engaged with the first engagement portion 171 of the release rod 17.

In accordance with the closing of the left cover 12, the roller holder 18 rotates downward and the substrate mounting structure 19 moves downward. Specifically, when the left cover 12 moves from the open position to the closed position, the lever pressing portion 14 (refer to FIG. 1) provided on the left cover 12 comes into contact with the lever 16 and presses the lever 16 to the right. As a result, the lever 16 rotates to the right around the lever shaft portion 161 against the urging force of the coil spring 168. In accordance with the rotation of the lever 16, the release rod 17 moves in the forward direction. Then, when the left cover 12 moves to the closed position, the release rod 17 moves to the front end position of the movable range. When the roller holder 18 rotates downward, the platen roller 78 is pressed against the thermal head 10 and the movable feed roller 79 is pressed against the roller 46. Along with the forward movement of the release rod 17, the guide portion 207 is engaged with the second engagement portion 172 of the release rod 17. As a result, the substrate mounting structure 19 moves downward. When the substrate mounting structure 19 moves downward, the detection switches 851 to 855 of the detection portion 850 are pressed against the indicator portion 800.

Figure 11:
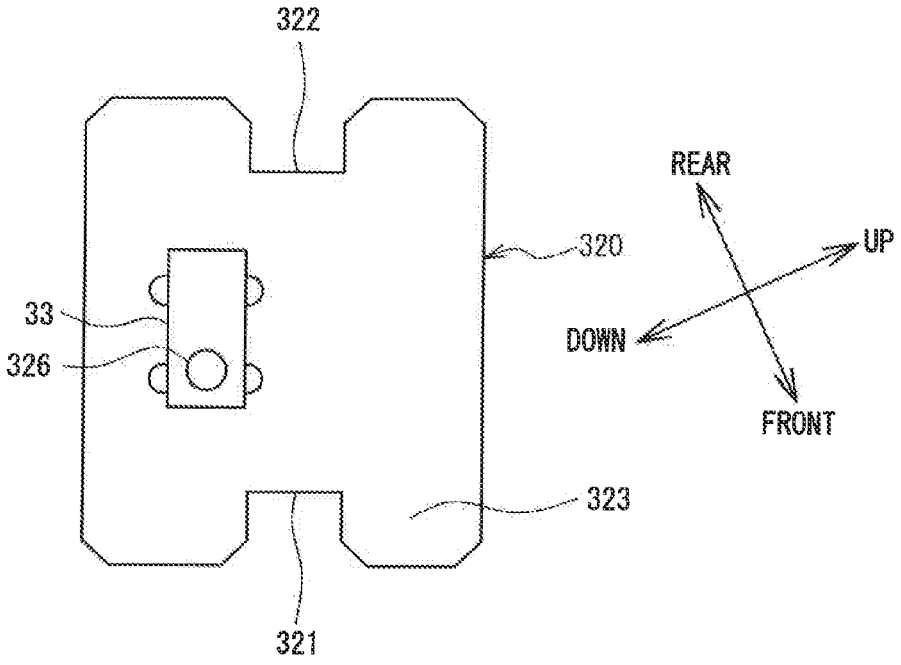
FIG. 11 is a left side view of the sensor substrate 320.

When the left cover 12 is in the closed position, the switch 326 of the sensor 33 shown in FIG. 11 is pressed by the sensor pressing portion (not shown in the drawings) provided on the left cover 12 and is changed to the ON state. The control portion of the tape printer 1 permits print processing during a period in which a signal indicating the ON state is acquired from the sensor 33. Thus, in the tape printer 1, it is possible to perform a printing operation using the tape cassette 30 mounted in the cassette mounting portion 7, and it is also possible to identify the tape attributes of the tape cassette 30. The operation when the left cover 12 is opened is an operation opposite to the operation when the left cover 12 is closed.

Figure 9:
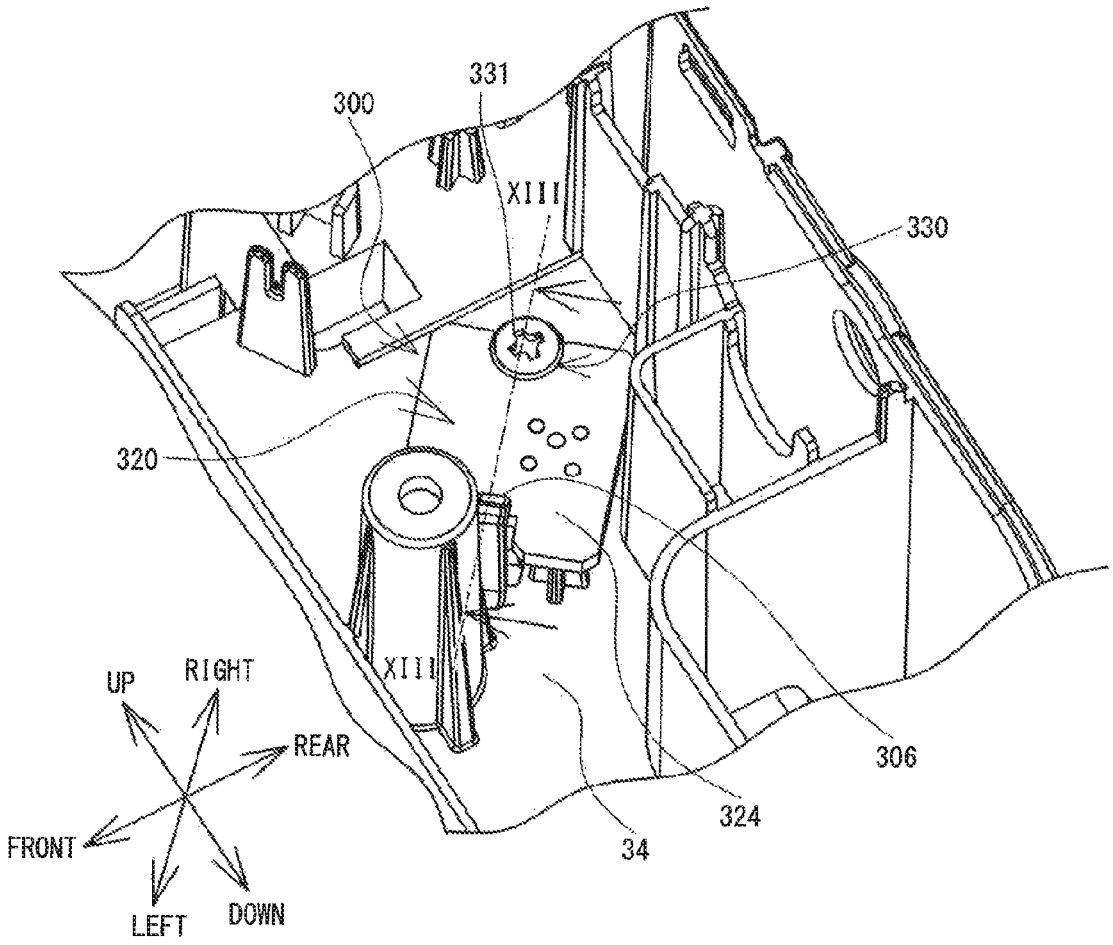
FIG. 9 is a perspective view of a substrate mounting structure 300.
Figure 10:
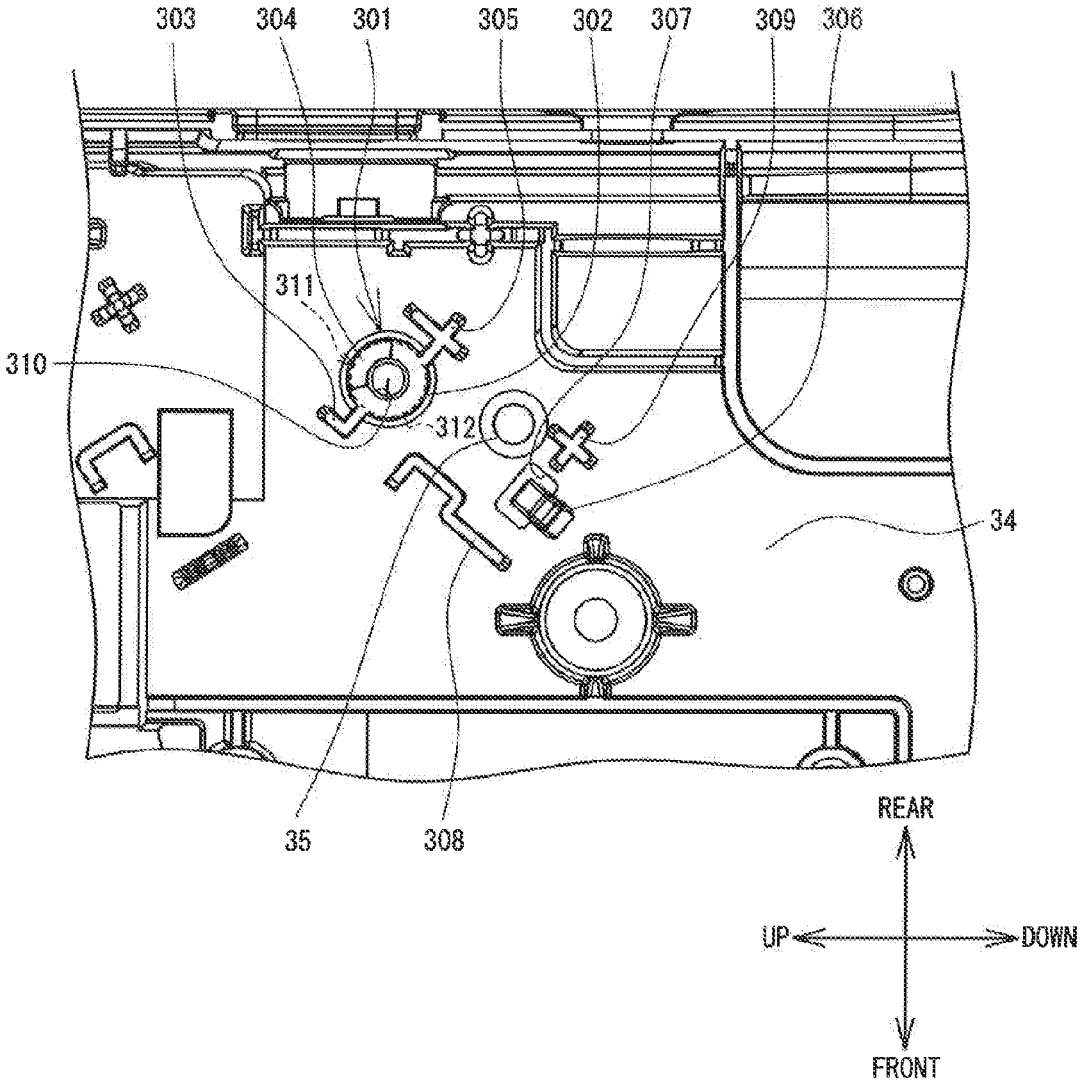
FIG. 10 is a right side view of the substrate mounting structure 300 when a sensor substrate 320 is removed.

A substrate mounting structure 300 of a sensor substrate 320 on which the sensor 33 is mounted will be explained with reference to FIG. 9 to FIG. 13. As shown in FIG. 9 and FIG. 10, the substrate mounting structure 300 is provided with the sensor substrate 320, a protruding body 301, a hook 306, rib portions 308 and 309, and a screw 330. As shown in FIG. 11, the sensor substrate 320 is a plate-shaped member having a rectangular shape in a left side view, and is formed in an H-shape that has cutout portions 321 and 322 at the center of a pair of opposing sides. The cutout portion 321 is provided in a section that corresponds to the hook 306. The cutout portion 322 is provided in a section that corresponds to a screw hole 310 that will be described later, in order to insert the screw 330. The side where the cutout portion 322 is formed is referred to as a side of an upper rear portion, and the side where the cutout portion 321 is formed is referred to as a side of a lower front portion. With respect to the rectangular sensor substrate 320 shown in FIG. 11, in a left side view (on a first surface 323 side), a section adjacent to the cutout portion 321 in the clockwise direction is referred to as a lower portion, a section adjacent to the cutout portion 321 in the counterclockwise direction is referred to as a front portion, a section adjacent to the cutout portion 322 in the clockwise direction is referred to as an upper portion, and a section adjacent to the cutout portion 322 in the counterclockwise direction is referred to as a rear portion. The sensor 33 is mounted on the first surface 323 that is the left surface of the sensor substrate 320. The sensor 33 has the mechanical switch 326. When the left cover 12 is closed, the switch 326 is pressed to the right by a pressing portion (not shown in the drawings) provided on the left cover 12 and is changed to the ON state. When the left cover 12 is opened, the pressing of the switch 326 by the pressing portion is released and the switch 326 is changed to the OFF state. Electrical wiring (not shown in the drawings) is connected to a second surface 324 (refer to FIG. 9) of the sensor substrate 320. The sensor substrate 320 is electrically connected to the control portion that is provided inside the tape printer 1, via the electrical wiring. The control portion of the tape printer 1 permits execution of printing only when the sensor 33 is in the ON state. Therefore, in the tape printer 1, in a state in which the left cover 12 is opened, the execution of the printing processing is reliably avoided.

Figure 12:
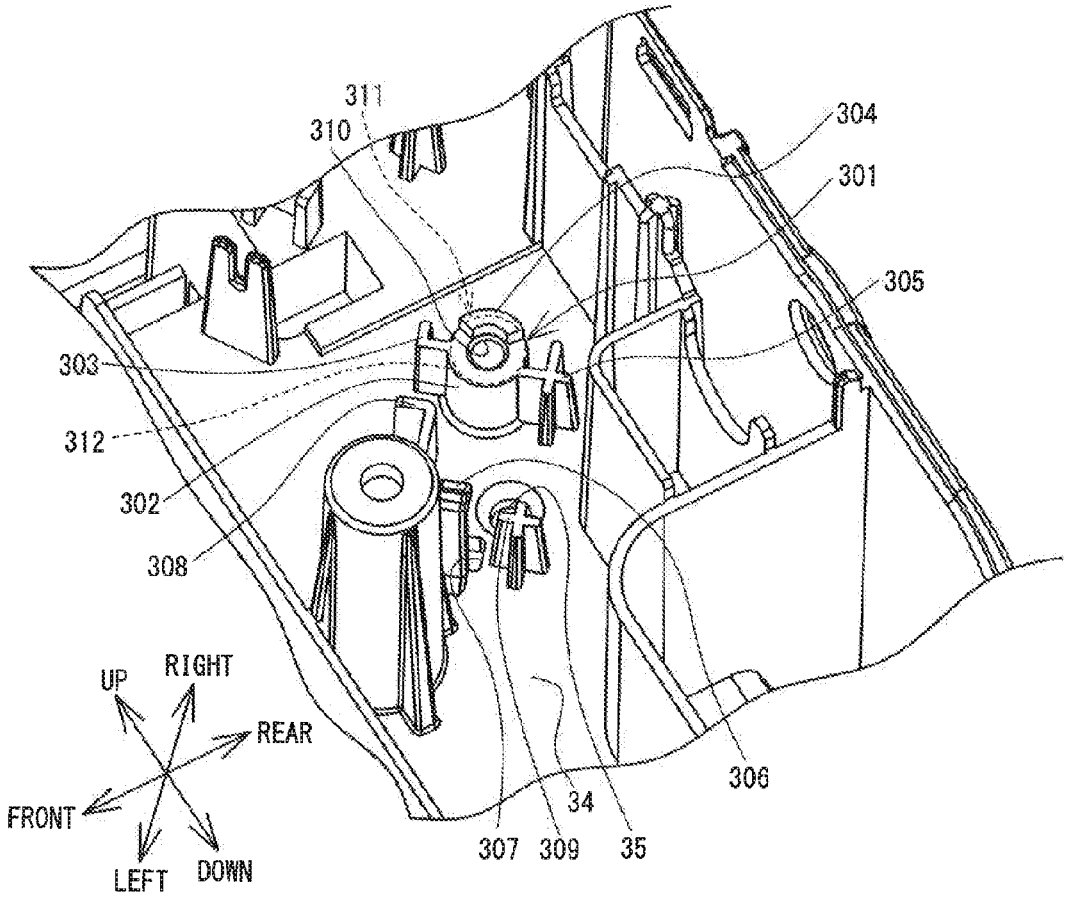
FIG. 12 is a perspective view of the substrate mounting structure 300 when the sensor substrate 320 is removed.

As shown in FIG. 10 and FIG. 12, the protruding body 301 is a section that is provided in a protruding condition from the wall 34 to the right. The protruding body 301 is provided with a boss portion 302, rib portions 303 and 305, and a protruding portion 304. The boss portion 302 is provided with a screw hole 310 to mount the sensor substrate 320. On the right surface of the boss portion 302, of a ring-shaped outer peripheral portion 311 of the screw hole 310, a section that comes into contact with the first surface 323 (refer to FIG. 11) of the sensor substrate 320 is referred to as a substrate support portion 312. The rib portions 303 and 305 are ribs that are connected to an outer peripheral surface of the boss portion 302, and the height of the rib portions 303 and 305 from the wall 34 is the same as that of the substrate support portion 312. The rib portion 303 faces an upper portion of the first surface 323 of the sensor substrate 320. The rib portion 305 faces a rear portion of the first surface 323 of the sensor substrate 320. The rib portions 303 and 305 are provided around the boss portion 302, and support the first surface 323 of the sensor substrate 320. The protruding portion 304 is provided on at least a part of a section of the outer peripheral portion 311 excepting the substrate support portion 312, and protrudes further in a second protruding direction than the substrate support portion 312. The second protruding direction is a direction (a direction D7 in FIG. 13) from the first surface 323 toward the second surface 324 (refer to FIG. 9), and in the present embodiment, the second protruding direction is the rightward direction. In the present embodiment, the right surface of the protruding portion 304 is a flat surface, and the value of the height of the protruding portion 304 extending in the second protruding direction from the substrate support portion 312 is substantially the same as the value of the thickness of the sensor substrate 320.

The hook 306 protrudes to the right from the wall 34, and its leading end is curved upward and to the rear. An upper rear portion of the hook 306 is provided with a hole 307 that penetrates the wall 34 in the left-right direction. The rib portions 308 and 309 are rib-shaped portions that are provided in a protruding condition from the wall 34 to the right such that the height of the rib portions 308 and 309 from the wall 34 is the same as that of the substrate support portion 312. The rib portion 308 faces a front portion of the first surface 323 of the sensor substrate 320. The rib portion 309 faces a lower portion of the first surface 323 of the sensor substrate 320.

Figure 13:
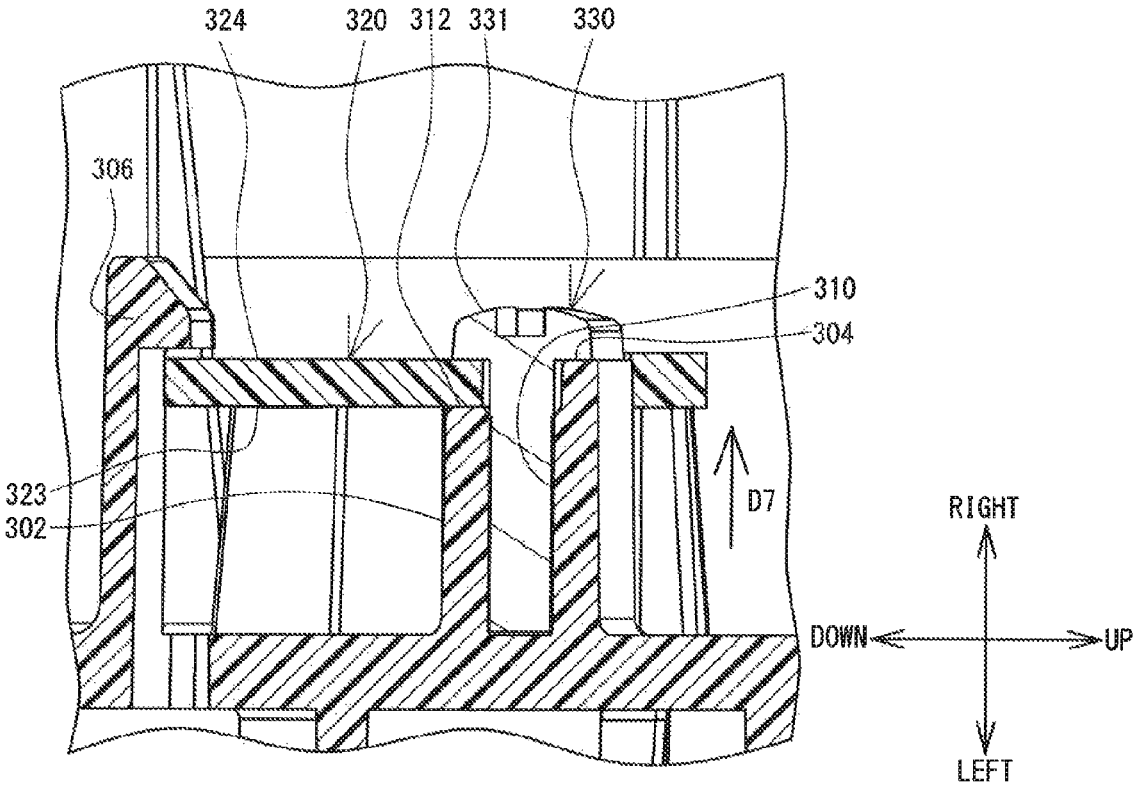
FIG. 13 is a cross-sectional view taken in the direction of arrows on a line XIII-XIII of the substrate mounting structure 300 shown in FIG. 9.

The sensor substrate 320 is mounted in the tape printer 1 in the following manner. In a state in which the first surface 323 of the sensor substrate 320 is directed to the left, the switch 326 is inserted through a hole 35 that is provided in the wall 34, and the cutout portion 321 of the sensor substrate 320 is fixed by the hook 306. The screw 330 is tightened into the screw hole 310 through the cutout portion 322. The side of the upper rear portion of the sensor substrate 320 is clamped by a head portion 331 of the screw 330 and the substrate support portion 312. Among the sides of the sensor substrate 320, the hook 306 fixes the side of the lower front portion that faces the side of the upper rear portion. In other words, among the sides of the sensor substrate 320, the hook 306 clamps the side that is opposite to the side supported by the substrate support portion 312. In the present embodiment, as shown in FIG. 13, the head portion 331 of the screw 330 comes into contact with both the second surface 324 of the sensor substrate 320 and the protruding portion 304. The first surface 323 of the sensor substrate 320 comes into contact with each of the rib portions 303 and 305, the substrate support portion 312 and the rib portions 308 and 309.

The substrate mounting structure 19 supports the sensor substrate 820 by using the head portion 221 of the screw 220 and the substrate support portion 209. The substrate mounting structure 300 supports the sensor substrate 320 by using the head portion 331 of the screw 330 and the substrate support portion 312. Therefore, in each of the substrate mounting structures 19 and 300, there is no need to provide a space to provide a screw hole in each of the sensor substrates 820 and 320, and it is possible to achieve space saving. When a protruding portion is not provided in a substrate mounting structure, a space is generated in which a head portion of a screw does not come into contact with a substrate. As a result, the head portion of the screw may significantly tilt with respect to the substrate, or a pressure may be locally applied to the substrate. Therefore, there is a possibility that, for example, the head portion of the screw sinks into the substrate or the substrate cracks. In contrast, with the substrate mounting structure 19 that is provided with the protruding portion 211, the sensor substrate 820 is clamped by the screw 220 and the substrate support portion 209. Since the substrate mounting structure 19 is provided with the protruding portion 211, it is possible to omit or reduce the aforementioned space. It is therefore possible to suppress the tilting of the head portion 221 of the screw 220, the sinking of the head portion 221 of the screw 220 into the sensor substrate 820, and the cracking or the like of the sensor substrate 820, and it is thus possible to suppress the mounting of the sensor substrate 820 from becoming unstable. Therefore, the substrate mounting structure 19 can stably mount the sensor substrate 820 without providing a screw hole in the sensor substrate 820. In the same manner, with the substrate mounting structure 300 that is provided with the protruding portion 304, the sensor substrate 320 is clamped by the screw 330 and the substrate support portion 312. Since the substrate mounting structure 300 is provided with the protruding portion 304, it is possible to omit or reduce the aforementioned space. It is therefore possible to suppress the tilting of the head portion 331 of the screw 330, the sinking of the head portion 331 of the screw 330 into the sensor substrate 320, and the cracking or the like of the sensor substrate 320, and it is thus possible to suppress the mounting of the sensor substrate 320 from becoming unstable. Therefore, the substrate mounting structure 300 can stably mount the sensor substrate 320 without providing a screw hole in the sensor substrate 320.

Various types of sensor substrate, such as the sensor substrates 320 and 820, can be mounted in the tape printer 1. Taking into account vibration that may be applied by falling or the like when the tape printer 1 is used, the sensor substrate of the tape printer 1 is required to be mounted in a relatively small space at such a strength that the sensor substrate does not come off even at a time of falling. In the tape printer 1, the space to provide each of the sensor substrates 320 and 820 can be reduced, in comparison to a case in which the mounting hole is provided in each of the sensor substrates 320 and 820. Further, in the tape printer 1, the sensor substrates 820 and 320 can be solidly mounted by using the screws 220 and 330, in comparison to a case in which the sensor substrates 320 and 820 are fixed to the tape printer 1 using hooks only.

In the substrate mounting structure 19 of the tape printer 1, the head portion 221 of the screw 220 directly comes into contact with both the second surface 827 of the sensor substrate 820 and the protruding portion 211. Therefore, when the screw 220 is tightened, it is possible to avoid a situation in which the posture of the sensor substrate 820 deteriorates or a pressure is locally applied to the sensor substrate 820. In the same manner, in the substrate mounting structure 300 of the tape printer 1, the head portion 331 of the screw 330 directly comes into contact with both the second surface 324 of the sensor substrate 320 and the protruding portion 304. Therefore, when the screw 330 is tightened, it is possible to avoid a situation in which the posture of the sensor substrate 320 deteriorates or a pressure is locally applied to the sensor substrate 320.

The rear right portion of the sensor substrate 820 is provided with the cutout portion 824 that corresponds to the screw 208. In the substrate mounting structure 19, in comparison to a case in which the substrate 820 is not provided with the cutout portion 824, it is possible to increase the area of the substrate support portion 209 and the area of a section of the head portion 221 of the screw 220 that comes into contact with the sensor substrate 820, under the condition that the area of the outer peripheral portion is the same. In other words, in the substrate mounting structure 19, it is possible to increase a section where the sensor substrate 820 surrounds the screw hole 208 and the screw 220, in comparison to a case in which the substrate 820 is not provided with the cutout portion 824. The sensor substrate 820 is clamped by the head portion 221 of the screw 220 and the substrate support portion 209. Therefore, the substrate mounting structure 19 can further reliably mount the substrate without providing a screw hole in the sensor substrate 820. The movement of the sensor substrate 820 to the right and to the rear is restricted by the screw 220 inserted through the cutout portion 824. Therefore, the substrate mounting structure 19 can position the sensor substrate 820 with respect to the screw hole 208. In the same manner, in the substrate mounting structure 300, in comparison to a case in which the substrate 320 is not provided with the cutout portion 322, it is possible to increase the area of the substrate support portion 312 and the area of a section of the head portion 331 of the screw 330 that comes into contact with the sensor substrate 320, under the condition that the area of the outer peripheral portion is the same. Therefore, the substrate mounting structure 300 can further reliably mount the substrate without providing a screw hole in the sensor substrate 320. The movement of the sensor substrate 320 to the right and to the rear is restricted by the screw 330 inserted through the cutout portion 322. Therefore, the substrate mounting structure 300 can position the sensor substrate 320 with respect to the screw hole 310.

When a substrate is clamped by a substrate support portion of a boss portion and a head portion of a screw, when the screw is tightened into a screw hole in a state in which the substrate is not fixed by a screw or the like, it is likely that the substrate becomes unstable or tilts. In contrast to this, the substrate mounting structure 300 is provided with the protruding portion 304 and thus reduces the space between the substrate support portion 312 and the head portion 331 of the screw 330. Therefore, in comparison to a case in which the protruding portion 304 is not provided, the substrate mounting structure 300 reduces the movable range of the substrate and makes it possible to avoid a situation in which the substrate 320 rotates or tilts at the time of mounting.

The substrate mounting structures 19 and 300 are provided with the hooks 203 and 306, respectively. In comparison to a case in which the sides that face the substrate support portions 209 and 312 are fixed using screws, the substrate mounting structures 19 and 300 can reduce the number of components and man-hours with a simple structure and can reliably fix the sensor substrates 820 and 320, respectively.

In the substrate mounting structure 300, the sensor substrate 320 is supported by the rib portions 303 and 305. Therefore, the sensor substrate 320 is unlikely to tilt when the screw 330 is tightened into the screw hole 310, and the sensor substrate 320 can be reliably fixed. In the substrate mounting structure 300, the rib portions 303, 305, 308 and 309 are used to support the vicinities of four corners of the sensor substrate 320. Therefore, the sensor substrate 320 is unlikely to tilt with respect to the substrate support portion 312.

The substrate mounting structure and the tape printer of the present disclosure are not limited to the above-described embodiment, and various modifications may be made without departing from the spirit of the present disclosure. For example, one of the following modifications (A) to (C) may be made as appropriate.

(A) The structure of the tape printer, the type of the tape cassette that can be mounted in the tape printer, and the type and structure of the tape that can be housed may be changed as appropriate. The substrate mounting structure may be provided in a device other than the tape printer 1. The substrate need not necessarily be the substrate on which a sensor is mounted. When applied to a device that is provided with a plurality of substrates, the substrate mounting structure of the present disclosure may be applied to some or all of the substrates provided in the device.

Figure 14:
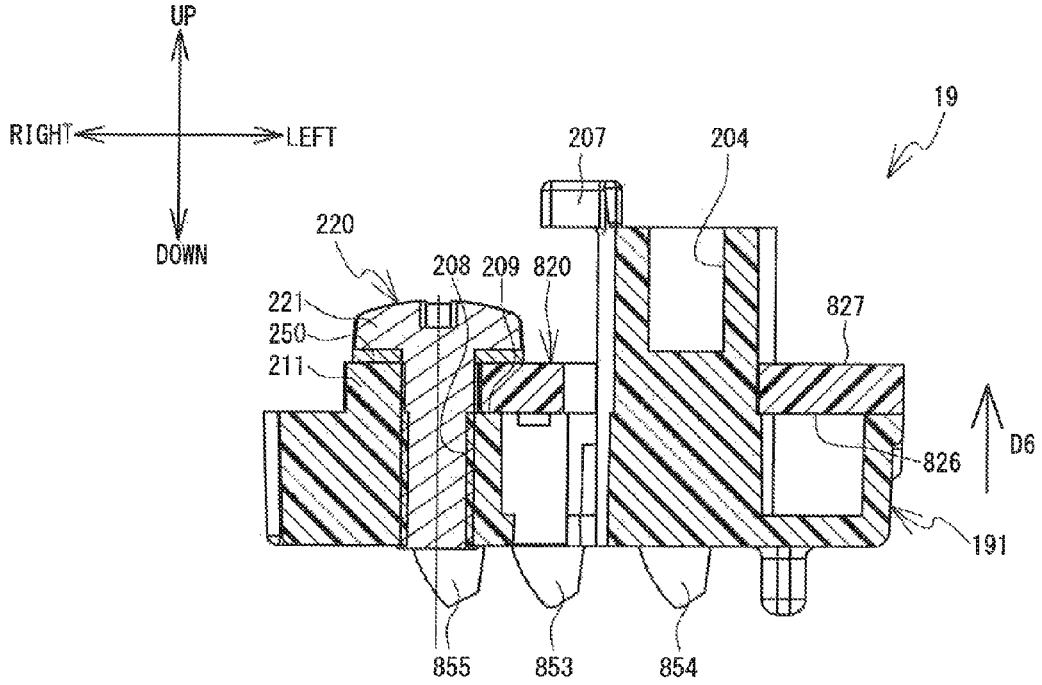
FIG. 14 is a view showing a manner in which a screw 220 comes into contact with a sensor substrate 820 and a protruding portion 211 via a washer 250 in the substrate mounting structure 19 shown in FIG. 8.

(B) The shape, the size and the like of the protruding portion that is provided on the outer peripheral portion of the screw hole may be changed as appropriate. The leading end of the protruding portion need not necessarily be flat. The head portion of the screw may come into contact with both the second surface of the substrate and the protruding portion, directly or via another member (for example, a washer 250 shown in FIG. 14), or may come into contact with only the second surface of the substrate. Also when the head portion of the screw comes into contact with only the second surface of the substrate, since the substrate mounting structure is provided with the protruding portion, it is possible to reduce the space between the substrate and the head portion of the screw. It is therefore possible to suppress the tilting of the head portion of the screw, the sinking of the head portion of the screw into the substrate, and the cracking or the like of the sensor substrate, and it is thus possible to suppress the mounting of the sensor substrate from becoming unstable. Therefore, the substrate mounting structure can stably fix the sensor substrate without providing a screw hole in the sensor substrate. From the viewpoint of reducing the space between the substrate and the head portion of the screw, within the outer peripheral portion of the screw hole, it is preferable for the ratio of the area provided with the protruding portion to the area excepting the substrate support portion to be as large as possible.

The substrate may be or may not be provided with the cutout portion in a section that corresponds to the screw hole, and the shape of the cutout portion may be changed as appropriate. When the substrate is mounted using a plurality of screws, it is sufficient if the substrate can be mounted using the substrate support portion and the head portion of the screw without providing a screw hole in the substrate, for at least one of the screws.

(C) The substrate mounting structure need not necessarily be provided with the boss portion having the substrate support portion and the screw hole. The shape and arrangement of the support portions that are provided around the boss portion may be changed as appropriate, or the support portions may be omitted according to need. The hook may be provided on one of the sides of the substrate, or may be omitted. The tape printer may use the above-described substrate mounting structure to mount a substrate on which the sensor is not mounted.

What is claimed is:

1. A substrate mounting structure for use in a printer comprising:

a substrate having a first surface and a second surface that is a surface on an opposite side to the first surface, wherein the substrate has a notch located along a perimeter thereof, and wherein the substrate is a sensor substrate on which a sensor is mounted;

a substrate support portion that includes a screw hole and that is a section of an outer peripheral portion surrounding an entrance of the screw hole, the section coming into contact with the first surface of the substrate such that the notch is positioned in a location corresponding to the screw hole;

a protruding portion that is provided on only a portion of the outer peripheral portion apart from the substrate support portion, and that protrudes farther in a direction from the first surface toward the second surface than the substrate support portion; and a screw that is screwed into the screw hole and that clamps the substrate together with the substrate support portion.

2. The substrate mounting structure according to claim 1, wherein a head portion of the screw comes into contact with both the second surface of the substrate and the protruding portion, one of directly and via another member.

3. The substrate mounting structure according to claim 1, further comprising:

a boss portion having the substrate support portion and the screw hole.

4. The substrate mounting structure according to claim 3, further comprising:

a support portion that is provided around the boss portion and that supports the first surface of the substrate.

5. The substrate mounting structure according to claim 1, further comprising:

a hook that clamps, among sides of the substrate, a side that faces the substrate support portion.

6. A tape printer comprising:

a substrate mounting structure that includes a substrate having a first surface and a second surface that is a surface on an opposite side to the first surface, wherein the substrate has a notch located along a perimeter thereof, and wherein the substrate is a sensor substrate on which a sensor is mounted;

a substrate support portion that includes a screw hole and that is a section of an outer peripheral portion surrounding an entrance of the screw hole, the section coming into contact with the first surface of the substrate such that the notch is positioned in a location corresponding to the screw hole;

a protruding portion that is provided on only a portion of the outer peripheral portion apart from the substrate support portion, and that protrudes farther in a direction from the first surface toward the second surface than the substrate support portion; and a screw that is screwed into the screw hole and that clamps the substrate together with the substrate support portion.

7. A tape printer comprising:

a substrate mounting structure that includes a substrate having a first surface and a second surface that is a surface on an opposite side to the first surface;

a substrate support portion that includes a screw hole and that is a section of an outer peripheral portion of the screw hole, the section coming into contact with the first surface of the substrate;

a protruding portion that is provided on at least a part of a section of the outer peripheral portion apart from the substrate support portion, and that protrudes farther in a direction from the first surface toward the second surface than the substrate support portion; and a screw that is screwed into the screw hole and that clamps the substrate together with the substrate support portion;

wherein the substrate is a sensor substrate on which a sensor is mounted.

* * * * *